United States Patent [19]

Belouet et al.

[11] 3,942,770

[45] Mar. 9, 1976

[54] DEVICE FOR STIRRING A LIQUID

[75] Inventors: Christian Belouet, Le-Plessis-Robinson; Jacques Charles Louis Bunel, Vigneux-sur-Seine, both of France

[73] Assignee: U.S. Philips Corporation, New York, N.Y.

[22] Filed: June 19, 1974

[21] Appl. No.: 480,679

[30] Foreign Application Priority Data

June 25, 1973 France ..... 73.23050

[52] U.S. Cl. ..... 259/95; 259/96; 259/107; 416/179; 416/186 R

[51] Int. Cl.[2] ..... B01F 5/12

[58] Field of Search ..... 259/95, 107, 108, 66, 67, 259/96, 16, 23, 24, 33, 43, 44, 7, 8; 416/179, 186

[56] References Cited

UNITED STATES PATENTS

| | | | |
|---|---|---|---|
| 374,753 | 12/1887 | Perkins | 259/96 |
| 1,936,053 | 11/1933 | Ghirardi | 416/179 |
| 3,278,295 | 10/1966 | Ostberg et al. | 259/108 X |
| 3,431,728 | 3/1969 | Bezimensky | 416/179 X |

*Primary Examiner*—Harvey C. Hornsby
*Assistant Examiner*—James A. Niegowski
*Attorney, Agent, or Firm*—Frank R. Trifari; David R. Treacy

[57] ABSTRACT

A device for stirring a liquid having two cup-shaped elements coaxially mounted on the end of a shaft. Radial vanes extend between the two elements to define liquid flow passages, the liquid entering from a hole at the apex of the outer cup. The outlet end of each of the vanes is bent at approximately a right angle to the rest of the vane.

3 Claims, 3 Drawing Figures

DEVICE FOR STIRRING A LIQUID

Figure 1:
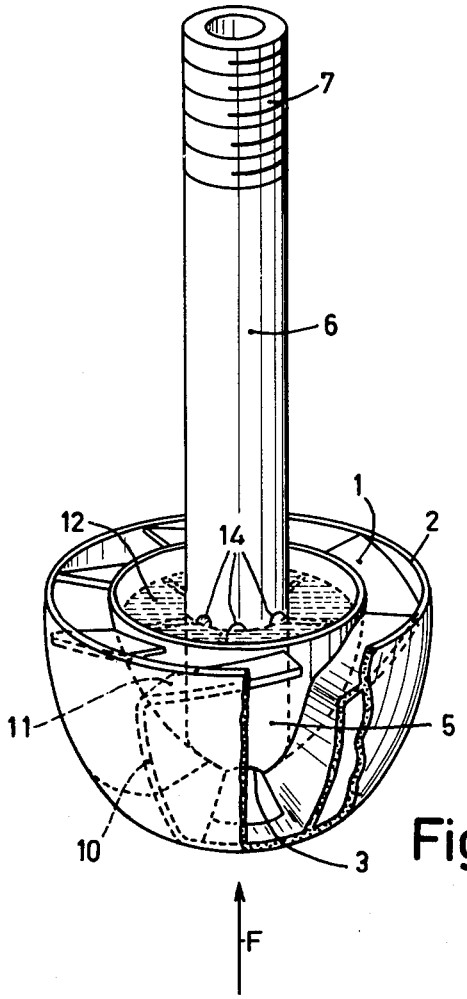

The invention relates to a device for stirring a liquid.

Mixing two liquids and dispersing solids in a liquid are operations which must be performed in many laboratory techniques.

Mixtures and dispersions are generally obtained by agitating the liquid medium to generate motion in the liquid in order to facilitate the blending of a first liquid with a second one or the regular dispersion of solids in a liquid, for the purpose of obtaining a homogeneous solution.

By means of devices which according to their functions are referred to as agitators, blenders, mixers etc. crystalline solutions or mixtures of liquids are obtainable.

Generally simple devices are used, such as mechanical rotary agitators. Such agitators generally comprise a shaft one end of which is connected to a motor and the other end of which caries an element intended to generate motion in the liquid.

According to the desired motion the element may take a variety of known forms, such as a propeller having a plurality of blades, a small rod or an assembly of two rods, a paddle or an assembly comprising at least two paddles of rectangular shape, or a flat paddle or a paddle having raised edges, at right angles to a shaft. It may furthermore be in the form of small interconnected tubes, of concentric rings or any other shape.

All these simple devices are designed to create motion, generally of a turbulent nature, in a liquid.

In some cases the quality of the resulting agitation is not sufficient to produce motion of the liquid in a given direction. When such motion is obtained by means of pumps or turbines, however, the resulting motion frequently is too violent and involves considerable perturbation and agitation in the entire volume of the liquid, which is not always desirable.

It is an object of the present invention to produce a homogeneous mixture and to maintain the homogeneity without disturbing the entire liquid volume.

A device according to the invention comprises two coaxial cup-shaped bodies of revolution, one being arranged within the other, which latter is formed with an opening at the location of its geometric apex and further is connected to the first body by blades which extend radially between the two bodies, the first body being provided with a driving shaft. The part of each blade which adjoins the bases of the two bodies is bent toward a plane perpendicular to the axis and preferably is at an angle of about 15° to this plane. The first body preferably also has an opening at the location of its geometric apex, which opening is extended by an axial duct in the first body which via a plurality of inclined apertures terminates at the location at which the driving shaft is secured to the first body.

The device enables the solution or the liquid medium in which it is immersed to be well homogenized without the entire volume being too violently perturbed or agitated.

Figure 2:
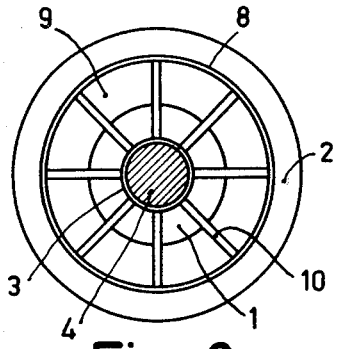
Figure 3:
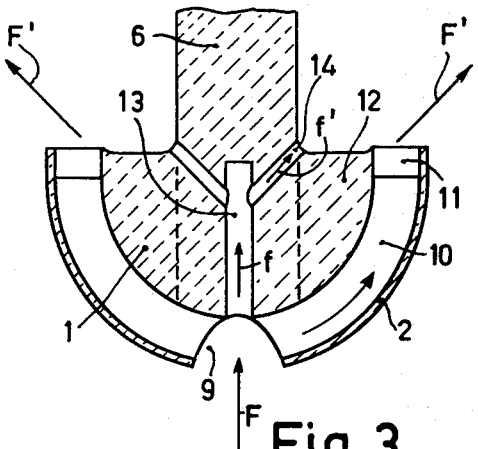

An embodiment of the invention will now be described, by way of example, with reference to the accompanying diagrammatic drawings, in which:

FIG. 1 is a perspective view of a stirring device according to the invention, part being cut away, FIG. 2 is a bottom plan view thereof, and FIG. 3 is a cross-sectional view thereof.

In the three Figures corresponding components are designated by like reference numerals.

Referring now to the Figures, the device comprises two coaxial hemispherical cups the smaller of which is designated by 1 and the larger by 2. The smaller cup 1 is formed, preferably at its apex, with an opening 4 in which an end 5 of a shaft 6 is secured; the other, screwthreaded end 7 of the shaft 6 is secured to a driving member, for example an electric motor, not shown, which imparts the required rotation movement to the device.

The larger cup 2 at its apex 8 has an opening 9 the diameter of which is greater than that of the opening 4; the two mutually centered cups are joined to one another throughout their heights by rigid radial blades 10 which exactly follow the shapes of the cups between which they are inserted; the upper parts of the blades 10 are bent at about right angles and form vanes 11 inclined with respect to the horizontal, adjacent the base end of cup 2 opposite its apex 8. In the embodiment described the blades 10 extend into the smaller-diameter hemispherical cup, which ensures secure attachment of the assembly of the two cups to the vertical driving shaft 6 and satisfactory rigidity of the device. The various components are joined by a method adapted to the material of which they are made, for example gluing, ultrasonic welding, etc.

From the above description it will be obvious that a liquid can circulate between the two hemispherical cups 1 and 2. The liquid is guided by the vertical blades 10 and the bent parts 11 thereof.

The smaller cup 1 may be filled with a compact material 12, for example polymethylmethacrylate, in which a central vertical duct 13 has been formed which through inclined openings 14 terminates at the base of the driving shaft 6.

The flow of the liquid is indicated by arrows in FIG. 3. Operation of the device may be explained in the following manner:

After the device has been immersed in a liquid medium, it is set into rotation by the shaft 6.

The rotation movement is imparted in the direction of inclination of the bent parts 11. Such movement causes liquid to be aspired so that it enters the device in the form of a column in the direction indicated by an arrow F; the liquid is entrained by the vertical blades 10 which move it upward along a helical path and guide it over the upper bent parts 11, which in turn drive the liquid and convey it along paths according to left-handed helices the envelope of which is a cone having an apical angle of 120° and a generatrix F′ (see FIG. 3).

A duct 13 and inclined openings 14 produce a second flow stream which enters at *f* and exits at *f′*; this second stream, which is produced by the centrifugal forces exerted on the interface of the upper horizontal surface, prevents the formation of undesirable vortices.

The method according to which a column of liquid is evenly induced and discharged at the top enables the medium to be well homogenized without giving rise to lateral disturbances which may be troublesome in certain uses, in particular for crystal growth on a seed.

In a practical embodiment the ratio between the diameter $D$ of the larger cup and the diameter $d$ of the smaller cup was $D/d \approx 2$.

The diameter of the driving shaft preferably is of the order of 6 mm. The number of vanes may lie between 4 and 8.

Such a device which had 6 vanes and the following dimensions: $D = 40$ mm, $d = 20$mm, diameter of the driving shaft = 10 mm, motor speed = 20 to 35 revolutions per minute, enabled a liquid to be agitated at the rate of 8 $cm^3$ per second with the formation of a cone having an apical angle of 120°. The large number of inclined openings formed at the lower end of the shaft enabled the undesirable vortices to be greatly reduced.

We claim:

1. A device for stirring a liquid, comprising an outer cup-shaped body having inner and outer surfaces of revolution about an axis, an apex and a base end opposite to the apex, and having an opening therethrough at said apex for the passage of liquid to be stirred; an inner cup-shaped body having an outer surface of revolution, an apex and a base end, disposed coaxially within said outer body; a plurality of blades extending radially between and connected to the outer surface of the inner cup and the inner surface of the outer cup, a first portion of each blade adjoining the base ends of said cups extending at a first angle with respect to a plane perpendicular to said axis, a second portion of each blade closer to said apices extending at a secoond angle from said plane greater than said first angle; and a driving shaft connected coaxially to said inner body at a location.

2. A device as claimed in claim 1, wherein said inner body has an axial duct in said body, an opening at the inner body apex communicating with said axial duct, and a plurality of ducts inclined to the axis, communicating at inner ends with the axial duct and at outer ends having openings adjacent said connection location.

3. A device as claimed in claim 1, wherein said first angle is approximately 15°.

* * * * *